US005112048A

United States Patent [19]

Kienle

[11] Patent Number: 5,112,048

[45] Date of Patent: May 12, 1992

[54] GARAGE ROOF PARTY GAME

[76] Inventor: Robert N. Kienle, 242 Fisher Rd., Grosse Pointe Farms, Mich.

[21] Appl. No.: 609,430

[22] Filed: Nov. 5, 1990

[51] Int. Cl.[5] ..... A63F 9/02

[52] U.S. Cl. ..... 273/121 R; 273/118 R; 273/122 R; 273/123 R; 273/127 R

[58] Field of Search ..... 273/118 R, 121, 122, 273/123, 124, 127 R, 127 B, 127 C

[56] References Cited

U.S. PATENT DOCUMENTS

| | | | |
|---|---|---|---|
| 1,996,986 | 4/1935 | Weinberg | 273/400 |
| 3,132,834 | 5/1964 | Adams | 273/738 |
| 3,647,213 | 3/1972 | Baker | 273/123 R |

*Primary Examiner*—Edward M. Coven

*Assistant Examiner*—Raleigh W. Chiu

*Attorney, Agent, or Firm*—Barnes, Kisselle, Raisch, Choate, Whittemore & Hulbert

[57] ABSTRACT

An outdoor game for family and friends gathered in a yard having a one-story garage roof or porch roof. The slanting, shingled roof is used to locate a plurality of traps to interrupt the descent of a ball thrown to the top area of the roof. The traps may be interspersed with diversion shields also distributed on the roof and located by flat plates inserted under shingle flaps. Baffle plates at the top of the roof are provided to prevent overthrow of the ball. A retriever shaft and arm can be used to remove the balls from the traps after a cycle of play. The traps can be provided with score indicia to allow scoring of a game by one or more players.

8 Claims, 2 Drawing Sheets

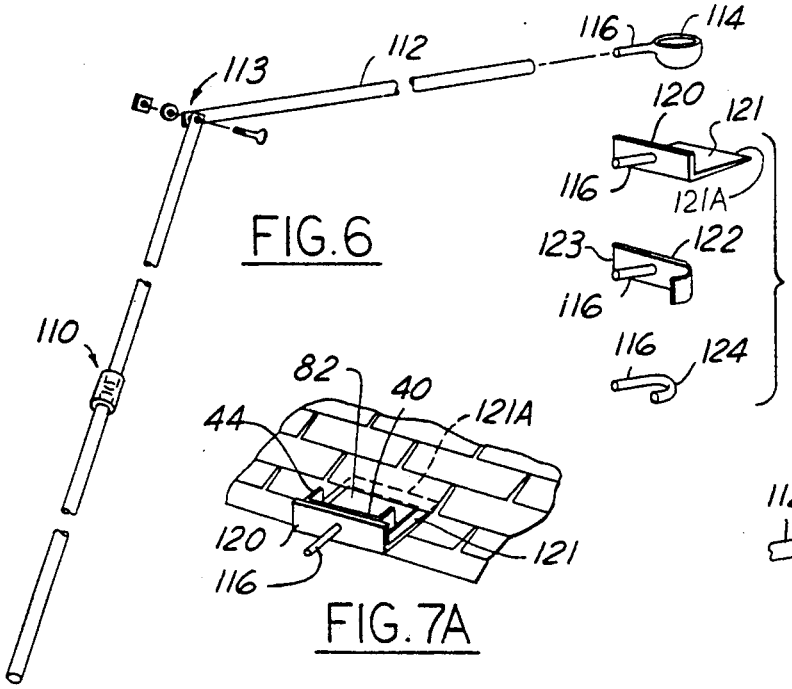
FIG. 6
FIG. 7
FIG. 7A
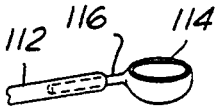
FIG. 8
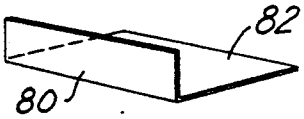
FIG. 9
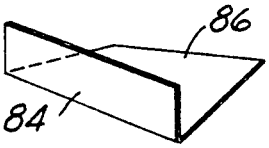
FIG. 10
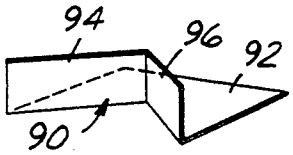
FIG. 11
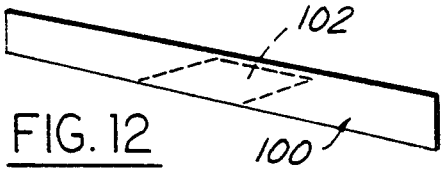
FIG. 12
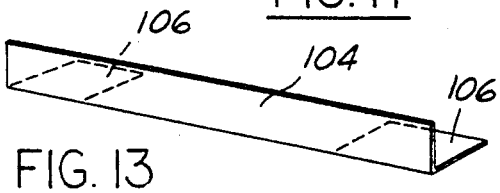
FIG. 13
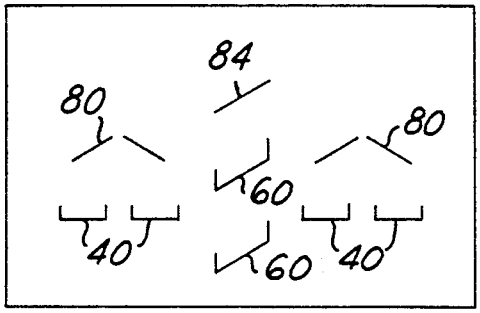
FIG. 14
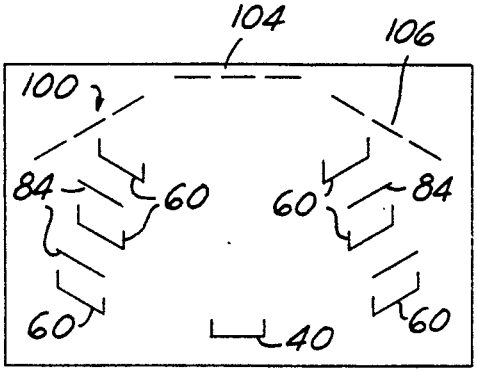
FIG. 15

GARAGE ROOF PARTY GAME

FIELD OF INVENTION

Games played in yards and playgrounds.

BACKGROUND AND FEATURES OF THE INVENTION

The use of backyard barbeques for gatherings of families and friends has become increasingly popular, especially with the use of gas-fired barbeque grills which eliminate the difficulties of firing up charcoal and waiting for the coal to develop sufficient heat for cooking. In addition, with the possibilities of fuel shortages for vehicle use, and the dangers on the highways during holiday weekends, many families are using the backyard as a recreation center.

Because of limited space, games such as softball or soccer are not feasible. Also, it is desirable to have a game which does not require a high degree of physical fitness and which can be enjoyed by children and senior citizens and even handicapped participants.

It is an object of the present invention to provide a game which can utilize a sloping roof such as that on a garage or screen porch extension on a house. The game can be played by young and old alike and can provide amusement for spectators as well as participants.

Other objects and features will be apparent in the following description and claims in which the invention is described and details provided to enable persons skilled in the art to practice the invention, all in connection with the best mode presently contemplated for the invention.

BRIEF DESCRIPTION OF THE INVENTION

The game, according to the present invention, involves the use of a slanting roof on which can be mounted catch plates and bins or traps open at the top to receive and halt the downward progression of a ball thrown to the top thereof. The catch plates can be categorized with various score figures so that a player can chalk up scores as each ball is thrown. An elongate retriever is provided to return the balls on ground level for re-use. Different color balls can be used if more than one player is to cast his ball seriatim before the retrieval. The catch plates can be secured to the roof by inserting a flat retention portion under the lower flap of a shingle. Deflectors as well as catch plates can also be used.

BRIEF DESCRIPTION OF THE DRAWINGS

DRAWINGS accompany the disclosure and the various views thereof may be briefly described as:

FIG. 6, a view of a retriever unit.

FIG. 7, a collective view of extension tools for installation and retrieval.

FIG. 7A, a view of an installation tool for positioning catch bins and deflectors.

FIG. 8, an individual view of a retriever too.

FIGS. 9 to 13, individual views of deflectors to be used in conjunction with catch bins.

FIGS. 14 and 15, views of layout arrangements for the catch bins and deflectors on a roof surface.

DETAILED DESCRIPTION OF THE INVENTION AND THE MANNER AND PROCESS OF USING IT

Figure 1:
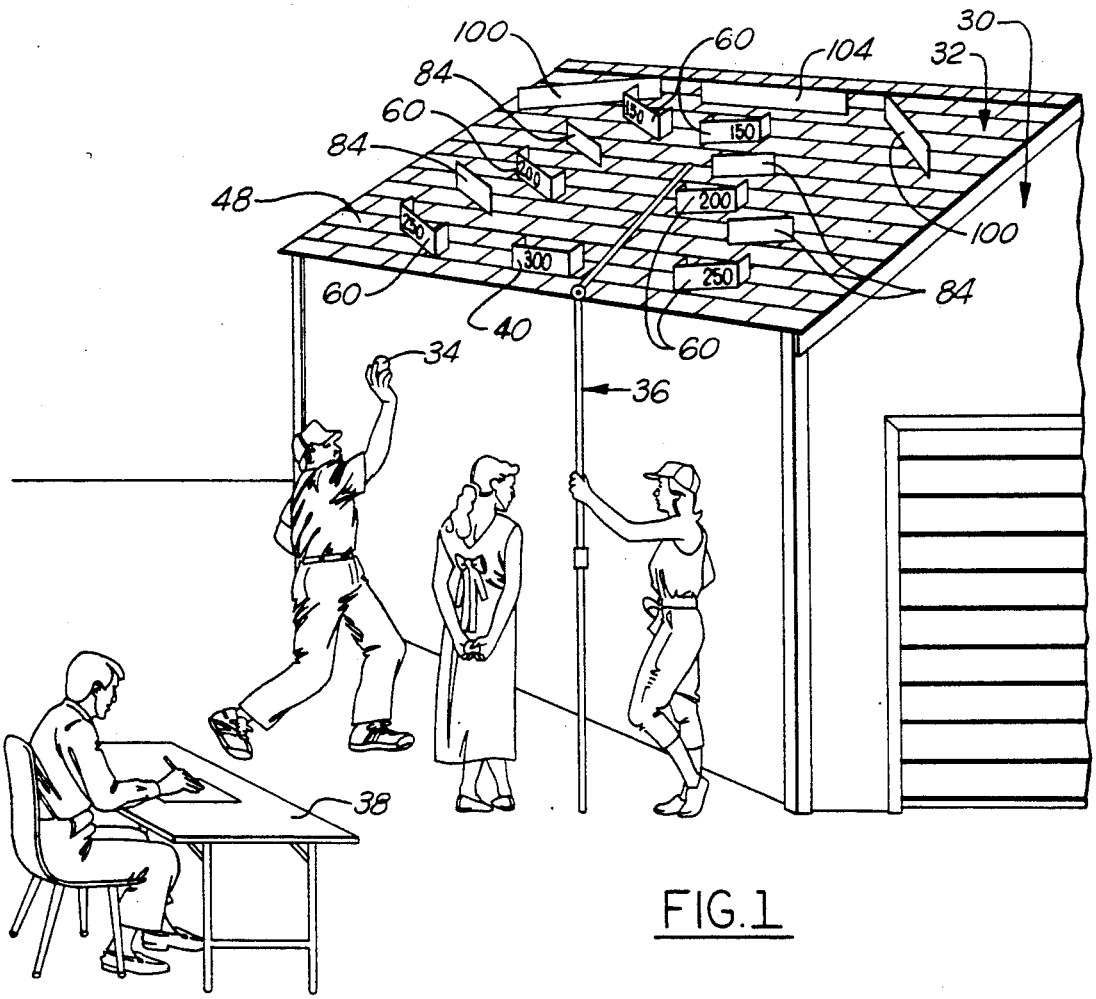
FIG. 1, a perspective view of a yard scene with a slanted roof structure and players.

With reference to FIG. 1, a structure 30 such as a garage with a slanted roof 32 is illustrated with participants including a player about to cast a ball 34, a retriever participant holding a retriever device 36, and a scorekeeper at a portable table 38.

Figure 2:
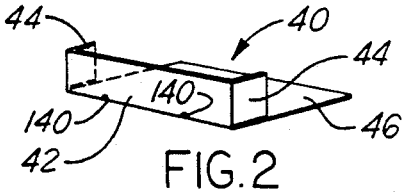
FIGS. 2 to 5, illustrations of a variety of catch bins to be used on a roof.
Figure 4:
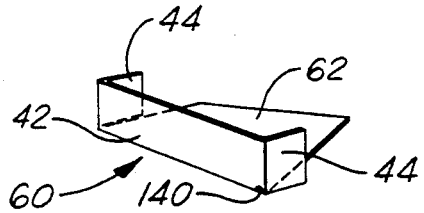
Figure 3:
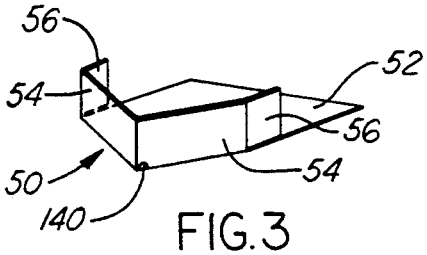

In FIG. 2, a rectangular catch bin 40 is illustrated with a front plate 42, side plates 44, and a flat retainer plate 46 which will insert under the flap of a shingle 48 to be retained on the slanting roof. In FIG. 3, a modified catch bin 50 is shown with the flat, slip-under retention plate 52, angled front plates 54 and side plates 56. In FIG. 4, a modified catch bin 60 is illustrated with the front and side plates 42 and 44 as in FIG. 2 but the flat retention plate 62 is angled with respect to the front and side plates so that it may readily be retained at an angle on the roof as illustrated in FIG. 1.

Figure 5:
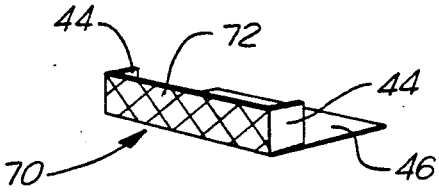

In FIG. 5, a retainer bin 70 is illustrated similar to that shown in FIG. 2 except that the front upright wall 72 is formed as a screen or lattice work to allow better visibility of a retained ball.

In FIGS. 9 to 13, various deflectors are shown to vary the layout on a roof slant. FIG. 9 shows a straight deflector 80 with a flat retention plate 82. FIG. 10 is similar but the retention plate 86 is angled with respect to the front plate 84 to facilitate mounting at an angle as in FIG. 1. FIG. 11 illustrates a deflector 90 with a flat retention plate 92 and angled front plates 94,96.

The retainer bins will be provided with drain openings as shown at 140 in FIGS. 2, 3 and 4 to allow rain run-off. Once mounted, the game elements may be retained on the roof or they may be readily removed, if desired, by pulling the flat retention plates out from under the shingle flaps.

FIGS. 12 and 13 illustrate, respectively, a backstop plate 100 with a central retention plate 102 and a back stop 104 with flat retention plates 106 at each end. These are illustrated in position at the top of the roof slant in FIG. 1. A penalty could be imposed if the cast ball overshoots the roof.

In FIG. 14, a diagrammatic view shows one arrangement of retainer bins and deflectors. In FIG. 15, a diagrammatic layout is illustrated as in FIG. 1.

Reverting now to FIGS. 7 and 8, the extension tools are shown for remote control of the bins and deflectors. The ball 34 to be used will preferably be about the size of a small "softball" but lighter so that it could be easily cast on to the roof but in descending it would not dislodge the deflectors or retainer bins. In FIG. 7, a retriever consists of a jointed handle shaft 110 with an overreach arm 112 mounted at a hinge-joint 113 so that the angle of the overreach arm 112 can be varied to suit a particular roof angle. Various retrieval ends may be optionally attached in a slip-on connection to the overreach arm 112.

In FIG. 6, an installation tool has a back riser 120 with a lifter shelf 121 which tapers in thickness from the riser 120 to a relatively sharp edge 121A. This shelf 121, while carrying a bin 40, can insert under the lower edge of a shingle to lift the shingle so that the retention plate 46 of a retainer bin 40 can be introduced under the shingle. The installation tool may be readily withdrawn leaving the bin in place. If needed, the flat end 123 of tool 122 can stabilize the bin 40 as the installation tool is withdrawn.

A cup device 114 having an attachment projection 116 can be used as a simple ball retriever. A simple hook 124 on a plate 122 can be used as a retriever and may be used also to remove the bins and deflectors from the roof. The game set can come with the various retrieval ends which may be selected by the person assigned to the ball retrieval after one or more casts. The respective retainer bins can be marked with visible indicia as shown in FIG. 1 so the scorer can register the score for any particular player. Several balls of the same color or different colors can be used to allow more than one cast in a particular set and to facilitate team play.

The placement of the bins, and the deflectors in relation to the bins can be varied to alter the complexity of the game. Simple placement for children can be changed to more difficult placement for adults.

With the above-described elements of the game, it will be evident that a number of players can be involved in a small area beside a slanted roof on a garage or other low structure with a roof-slant, such as a one-story addition or a screen porch. A ball is cast by a player to the top of the roof and will roll down to be deflected and then trapped in a particular retainer bin which will have a designated score. The plays may be made by one participant at a time or several may cast a ball. Once a designated set is finished, the retriever unit can be used to retrieve the balls and a new set initiated.

If groups of colored balls are provided, teams could be used to compete against each other. When a retainer bin is filled, for example, it would not be available for a score by a competing team. The bins and balls could also be colored differently for each team so that each team could have "home" bins, and points for landing in the "home" bins would be different than landing in an opponent's bin. Additional variation can be devised to foster competition in the playing.

What is claimed is:

1. An outdoor scoring game for individual participants which comprises:

(a) an elevated sloping roof on a garage, (b) a series of spaced retainer bins mounted on said roof having means to retain a ball rolling down to the roof, (c) one or more balls to be cast onto the roof by a participant, (d) a series of spaced upright deflectors mounted on said sloping roof above said retainer bins in random array to provide a tortuous path for a ball descending said roof, (e) said roof being composed of overlapping shingles, and said retainer bins and said deflectors comprise upstanding portions projecting away from the plane of said roof and retention portions lying flat against said roof, said retention portions underlying overlapping shingles to be retained in position by frictional engagement with said shingles, and (f) a shaft to be manually manipulated, a portion on said shaft to reach over said roof, and a locator tool on the distal end of said portion selectively to lift, locate and push a retainer bin into a position where a retention portion is located under an overlapping shingle, (g) said locator tool comprising an L-shaped element shaped to carry a retention bin or deflector having an upstanding leg to push against the upstanding portion of a bin or deflectors, and a lifting shelf to introduce the retention portion under an overlapping shingle.

2. An outdoor scoring game as defined in claim 1 in which said lifting shelf has a distal edge narrowed in thickness to move under a shingle.

3. An outdoor scoring game for individual participants which comprises:

(a) an elevated sloping roof on a garage, (b) a series of spaced retainer bins mounted on said roof having means to retain a ball rolling down said roof, (c) one or more balls to be cast onto the roof by a participant, (d) a series of spaced upright deflectors mounted on said sloping roof above said retainer bins in random array to provide a tortuous path for a ball descending said roof, (e) a series of backstop plates extending essentially normal to the plane of the roof positioned above the deflectors and retention bins to block overthrow of the game balls, and (f) a shaft to be manually manipulated having a portion to reach over said roof, and means on the distal end of said shaft to contact and release previously cast balls from said retainer bins.

4. An outdoor scoring game for individual participants which comprises:

(a) an elevated sloping roof on a garage, (b) a series of spaced retainer bins mounted on said roof having means to retain a ball rolling down said roof, (c) one or more balls to be cast onto the roof by a participant, (d) a series of spaced upright deflectors mounted on said sloping roof above said retainer bins in random array to provide a tortuous path for a ball descending said roof, (e) said roof being composed of overlapping shingles, and said retainer bins and said deflectors comprise upstanding portions projecting away from the plane of said roof and retention portions lying flat against said roof, said retention portions underlying overlapping shingles to be retained in position by frictional engagement with said shingles, and (f) a shaft to be manually manipulated, a portion on said shaft to reach over said roof, and a locator tool on the distal end of said portion selectively to lift, locate and push a retainer bin into a position where a retention portion is located under an overlapping shingle.

5. An outdoor scoring game for individual participants which comprises:

(a) an elevated sloping roof on a garage, (b) a series of spaced retainer bins mounted on said roof having means to retain a ball rolling down said roof, (c) one or more balls to be cast onto the roof by a participant, (d) a series of spaced upright deflectors mounted on said sloping roof above said retainer bins in random array to provide a tortuous path for a ball descending said roof, (e) said roof being composed of overlapping shingles, and said retainer bins and said deflectors comprise upstanding portions projecting away from the plane of said roof and retention portions lying flat against said roof, said retention portions underlying overlapping shingles to be retained in position by frictional engagement with said shingles, (f) said retainer bins comprising an upstanding V-shaped portion to extend essentially normal to the roof plane, and a retention plate extending from said V-shaped portion to lie in the plane of the roof under an overlapping shingle, and (g) said retention plate having a leading edge angled to said upstanding portion to facilitate location of said retainer bin at an angle to the roof edge.

6. An outdoor scoring game for individual participants which comprises:

(a) an elevated sloping roof on a garage, (b) a series of spaced retainer bins mounted on said roof having means to retain a ball rolling down said roof, (c) one or more balls to be cast onto the roof by a participant, and (d) a shaft to be manually manipulated having a portion to reach over said roof, and means on the distal end of said shaft to contact and release previously cast balls from said retainer bins.

7. An outdoor scoring game for individual participants which comprises:

(a) an elevated sloping roof on a garage, (b) a series of spaced retainer bins mounted on said roof having means to retain a ball rolling down said roof, (c) one or more balls to be cast onto the roof by a participant, and (d) a series of spaced upright deflectors mounted on said sloping roof above said retainer bins in random array to provide a tortuous path for a ball descending said roof, (e) said roof being composed of overlapping shingles, and said retainer bins and said deflectors comprise upstanding portions projecting away from the plane of said roof and retention portions lying flat against said roof, said retention portions underlying overlapping shingles to be retained in position by frictional engagement with said shingles.

8. An outdoor, scoring-game kit for individual participants which comprises:

(a) a series of spaced retainer bins to be mounted in spaced relation on an elevated sloping roof, said bins having upstanding means to retain a ball rolling down the roof, (b) one or more balls to be cast onto the roof by a participant, (c) a retrieval shaft having a proximal end to be manually manipulated and a distal end to be extended over said roof above said retainer bins, and (d) means on said distal end of said shaft to contact and release previously cast balls from said retainer bins.

* * * * *